United States Patent [19]

Gudgel et al.

[11] 4,421,447

[45] Dec. 20, 1983

[54] ELEVATOR TRANSFER AND SUPPORT SYSTEM

[75] Inventors: Howard S. Gudgel; William E. Guier, both of Tulsa, Okla.

[73] Assignee: Zena Equipment, Inc., Tulsa, Okla.

[21] Appl. No.: 241,508

[22] Filed: Mar. 9, 1981

[51] Int. Cl.[3] ..... E21B 19/06

[52] U.S. Cl. ..... 414/22; 166/77.5; 294/90

[58] Field of Search ..... 414/22, 745; 166/77.5, 166/85; 175/52, 85; 294/102 A, 90, 86 A

[56] References Cited

U.S. PATENT DOCUMENTS

| | | | |
|---|---|---|---|
| 3,063,509 | 11/1962 | Guier | 414/22 X |
| 3,099,323 | 7/1963 | Kelley | 166/77.5 X |
| 3,267,783 | 8/1966 | Kepes | 414/745 X |
| 3,308,970 | 3/1967 | Wilson et al. | 414/22 |
| 3,532,229 | 10/1970 | Scaggs | 414/22 |
| 3,680,412 | 8/1972 | Mayer et al. | 175/85 X |
| 3,929,235 | 12/1975 | Howard et al. | 414/22 |
| 3,941,413 | 3/1976 | Johnson et al. | 294/86 A |
| 4,108,318 | 8/1978 | Rode et al. | 414/745 X |
| 4,253,219 | 3/1981 | Krasnov | 294/102 A X |

*Primary Examiner*—Robert J. Spar
*Assistant Examiner*—Janice Krizek
*Attorney, Agent, or Firm*—Head, Johnson & Stevenson

[57] ABSTRACT

In a drilling apparatus for handling strings of drill pipe on a drilling rig which includes a lift member or travelling block positionable over a borehole and carrying a pair of bails or links supported from the lift member at their upper ends, and having open loops at their lower ends which serve to lift the elevators. A link powered control device is attached to the lifting member so that, on command, it will spread the links so that they can be removed from one elevator and will draw the links backwards, away from the borehole, for attachment to a second elevator. The invention comprises a setback platform mounted on the drilling floor with spaces on its surface for positioning a second elevator while a first elevator is positioned on the rotary table. Hydraulic or pneumatic cylinders are provided, for moving an elevator from the rotary table to the surface plate of the setback platform, and back to the rotary table. Troughs are provided that extend forwardly, on each side of the rotary table, so as to provide forward stops as the links are moved to center the open loops to the elevator over the borehole. Stops are also provided on the back, to limit the backward motion of the links so as to be positioned properly with reference to the second elevator on the setback platform.

14 Claims, 11 Drawing Figures

ELEVATOR TRANSFER AND SUPPORT SYSTEM

CROSS-REFERENCE TO RELATED APPLICATION

This application is related in subject matter to co-pending application, Ser. No. 164,002, filed June 30, 1980, now U.S. Pat. No. 4,326,745, entitled, "LINK CONTROL SYSTEM FOR USE WITH DUAL ELEVATORS".

SUMMARY OF THE INVENTION

It is a primary object of this invention to provide an improved drilling apparatus for handling stands of drill pipe in a drilling rig while drilling in a borehole in the earth. A more particular object is to provide a setback platform means positioned on the drilling floor in close proximity to the rotary table, including means for guiding the links which are used to lift the dual elevators.

These and other objects are realized and the limitations of the prior art are overcome in this invention which provides a portion of an improved drilling system for handling stands of drill pipe on a drilling rig during the drilling operation. The apparatus is particularly applicable for use with a dual elevator system in which a pair of elevators are slidably positioned on a setback platform means adjacent the borehole. This invention is used in conjunction with apparatus for controlling the links attached to the lifting means, so that they can be remotely controlled to couple and decouple from the elevators to thereby enable drilling operators to run stands of drill pipe into and out of a borehole more quickly and safely.

The improved drilling apparatus includes a lifting member or travelling block which is elevationally positionable in a drilling rig coaxially over a borehole. Links are pivotally supported at their upper ends to the opposite sides of the lifting member. The links are spaced apart and generally parallel to each other. They have open loops at their upper ends which are supported by hooks on the lifting member and also have open loops at their lower ends for attachment under hooks which form a part of the elevators.

Link control means are provided, attached to the lifting member, which form the subject of co-pending application, Ser. No. 164,002. This link control mechanism provides pneumatic or hydraulic control cylinders for separating the lower ends of the links and also to pivot them from the open loops at their upper ends, so that the open loops at the lower ends of the links can be displaced backwardly, away from the vertical position.

This invention of the setback platform means and stool forms part of the drilling system. It comprises a frame which is attached rigidly to the floor of the drilling unit and is positioned precisely with reference to the rotary table, both in radius and in azimuth, so that the center line of the platform will pass through the center of the borehole, and the center line will be in a vertical plane through the center of the lifting means, and perpendicular to the axis of the pulleys in the lifting means, through which the lifting cable is wrapped.

The center line of the setback platform is therefore parallel to the central axis of the paths of the bottom ends of the links, so that as they are drawn backwardly they will move parallel to the centerline of the setback platform. The setback platform has a top plate which has a semi-circular cut at its front end facing the rotary table and adapted to be positioned close to, but separated from, the circumference of the stool and rotary table. The vertical position of the top of the setback platform is at the same level as the top surface of a stool, which is a circular cylindrical means, which is placed on, and accurately indexed (by pins) to the top surface of the rotary table. A removable door is provided in the front end of the stool so that it can be removed from around the pipe. A slip bowl may be positioned in the stool to accept standard drilling slips.

Means are provided for indexing the azimuth of the rotary table and the stool to the setback platform. Thus, as the rotary table stops turning prior to changing the drill pipe, it will be at a particular azimuth with respect to the setback platform. The reason for this is that there is a keyway or channel in the top surface of the stool and in the top plate of the setback platform, and there is also a corresponding key attached to the bottom of each of the elevators so that when the elevator is placed on the stool the key will fit into the keyway in the stool and in the platform. This provides a means of withdrawing the elevator from a first position centered over the borehole, to a second position where it is displaced, or setback, from the borehole and is completely out of the way of personnel and machinery while the drilling is taking place. Hydraulic or pneumatic means are provided on the platform to move an elevator from the first position to the second position, or back, entirely automatically.

The setback platform has two rectangular troughs which are retractable. In their forward position they are below the links of the lifting means. Thus, if the drill string is hanging from the first elevator in the borehole, the lifting means can be lowered, the link control means operated so as to spread the bottom ends of the link so that they can be free of the hooks and inside of the troughs.

The link mechanism then deflects the bottom ends of the links backward until they strike a stop—the batter board of the platform. They are then in position opposite the hooks of the second elevator which is in the setback position. Then as the lift means is lifted, the links are drawn together, and the open loops are hooked under the hooks of the second elevator, which can then be lifted.

Pneumatic or hydraulic push-pull means are provided to slide an elevator from the setback position to the first position over the borehole, and vice versa.

U.S. Pat. No. 3,063,509, which has been included by reference in this application, fully describes how the dual elevators are used in this improved drilling system and they need not be described further at this time.

BRIEF DESCRIPTION OF THE DRAWINGS

These and other objects and advantages of this invention and a better understanding of the principles and details of the invention will be evident from the following description taken in conjunction with the appended drawings, in which.

DETAILED DESCRIPTION OF THE PREFERRED EMBODIMENTS

Figure 1:
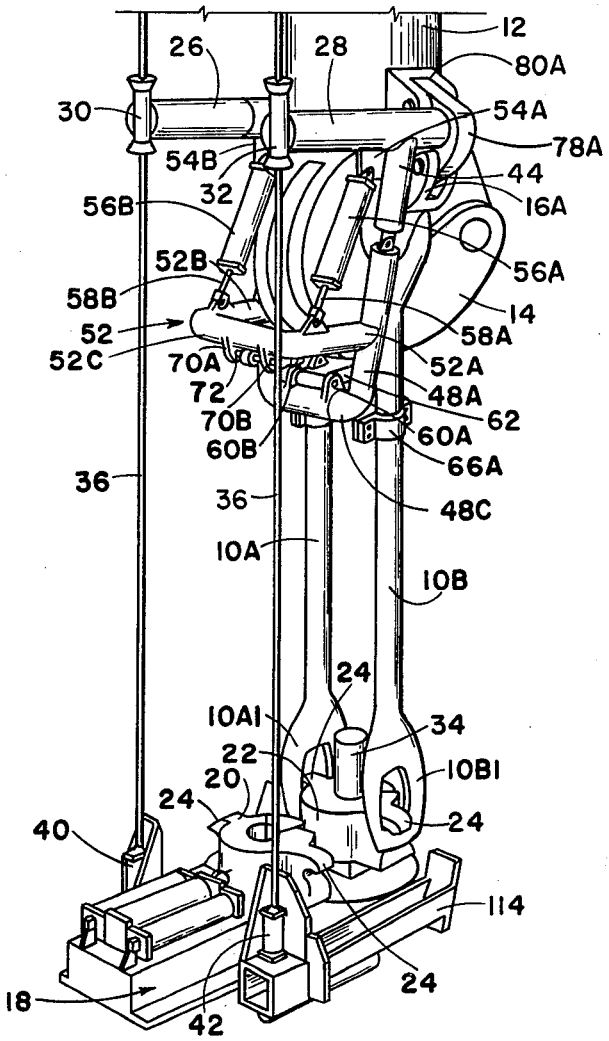
FIG. 1 is substantially identical to FIG. 1 of co-pending application, Ser. No. 164,002.
Figure 3:
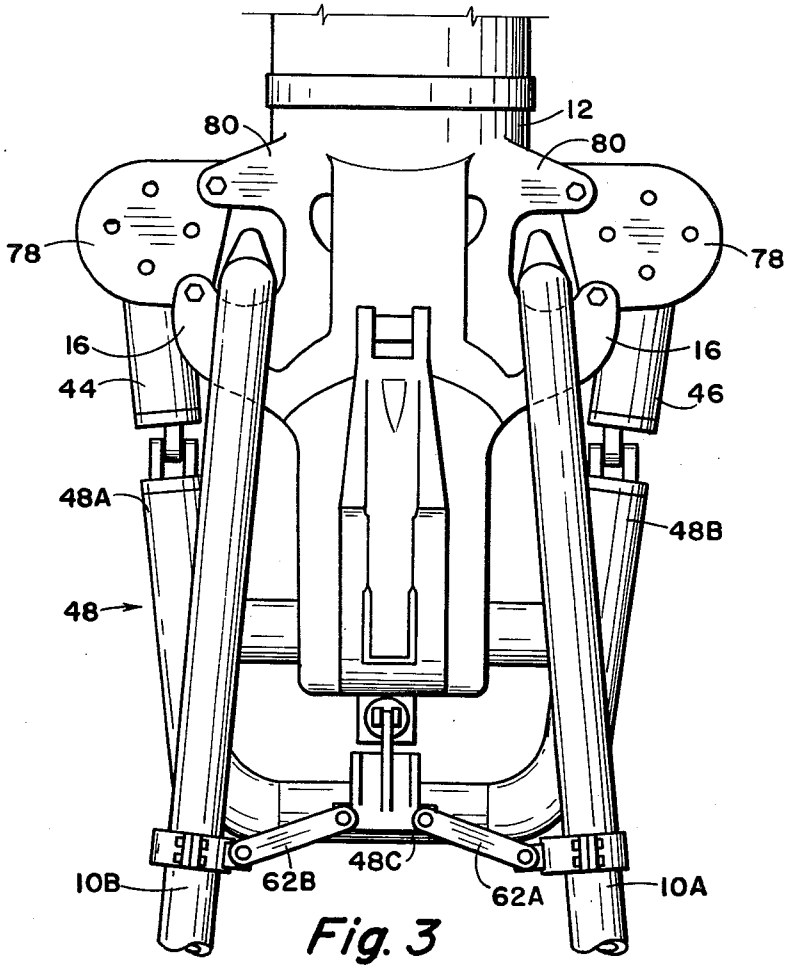
FIGS. 2 and 3 are substantially identical to FIGS. 4 and 5 respectively of my co-pending application, Ser. No. 164,002.
Figure 2:
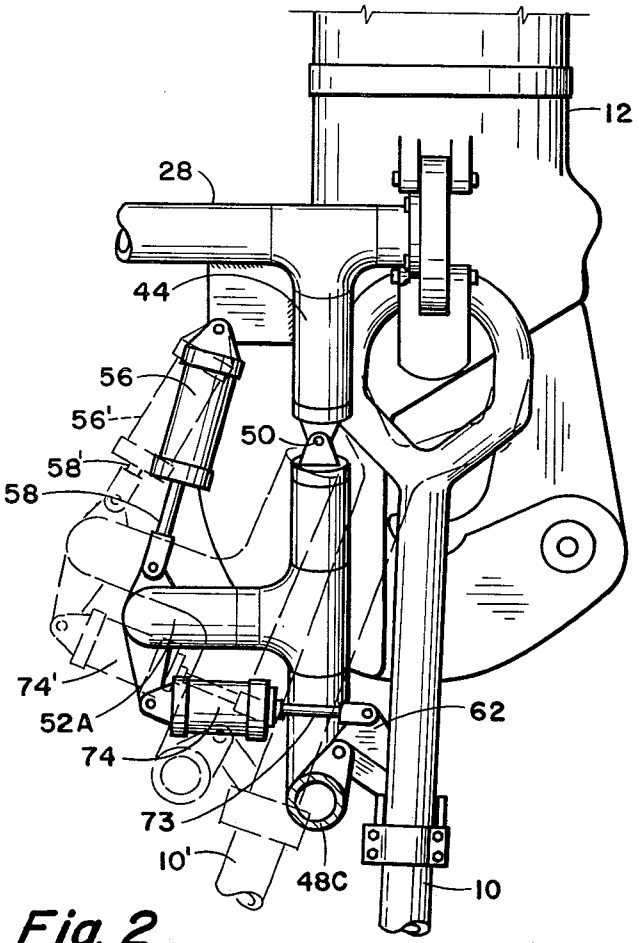

Referring now to the drawings and in particular to FIGS. 1, 2, and 3. These figures are taken from co-pending application, Ser. No. 164,002.

FIG. 1 shows an isometric view of a major part of the improved drilling system of which this invention is a part. One of its principal features is apparatus for accurately controlling links 10A and 10B.

The use of links in drilling oil and gas wells is well known. The links are supported at their upper ends to a lifting member 12 such as a hook or travelling block. Above the lifting member 12, and not shown since it is standard drilling technology, is an apparatus for elevationally positioning the lifting member which is usually in the form of a block having a plurality of parallel pulleys which are supported by a cable extending from a crown block in the upper end of the derrick. By controlling the length of the cable interconnecting the crown block and the pulleys, the elevation of the lifting member 12 can be changed.

As shown in FIGS. 2 and 3, the lifting member 12 includes integral opposed ears 16 which receive the upper end of links 10A and 10B. In the usual fashion, the upper end of each of the links includes a closed loop as shown in FIG. 2, and in like manner, the lower end of the links includes closed loops 10A1 and 10B1, as shown in FIG. 1. The function of this mechanism is to provide means to shift the lower ends of the links, one reason being to permit the ready attachment to, and detachment from, dual elevators. Reference has previoulsy been made to Guier U.S. Pat. No. 3,063,509 which introduced the dual elevator system to the petroleum industry.

In FIG. 1 is shown a setback platform means, attached to the floor of the drill rig and indicated generally by the numeral 18. Slidably positioned on the setback platform 18 is a pair of elevators, indicated by the numerals 20 and 22. Each of the elevators 20 and 22 includes integral horns or hooks 24 extending from opposite sides of the elevator. The setback platform will be fully described in relation to succeeding figures.

The setback platform 18 is for storing and handling the two elevators of the dual elevator system and for providing means to control the forward and backward position of the elevators with respect to the axis of the borehole. The apparatus also facilitates the transfer of the lifting links from one elevator such as the one which is positioned over the borehole, to a second elevator which is positioned at the second or setback position on the setback platform.

For background information as to the application of a dual elevator system in the drilling of oil and gas wells, reference may be had to U.S. Pat. No. Re 29,995, entitled "DUAL ELEVATORS", issued to William E. Guier.

Figure 4:
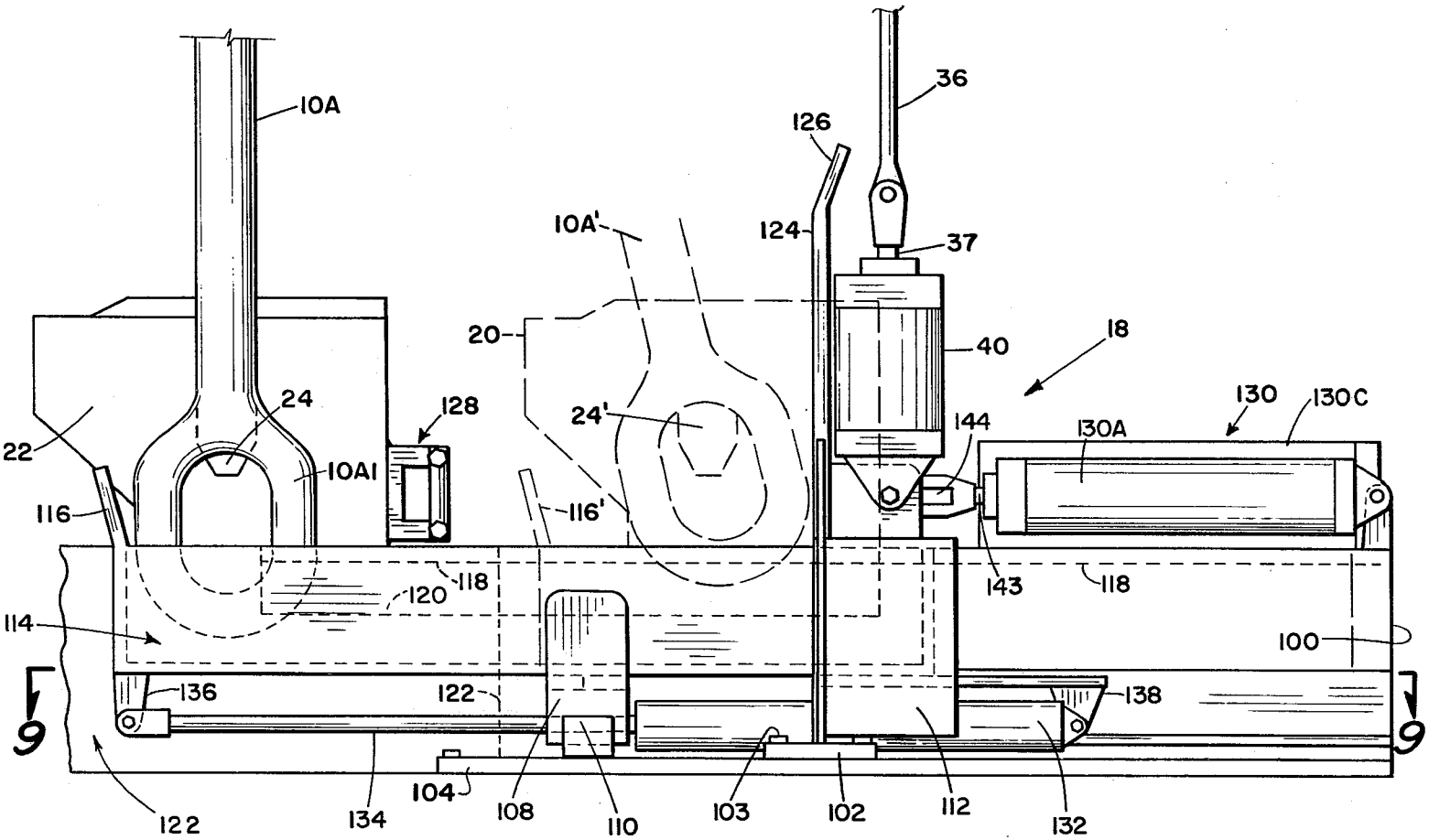
FIGS. 4 and 5 illustrate an elevation view and a plan view of the setback platform means, respectively.
Figure 5:
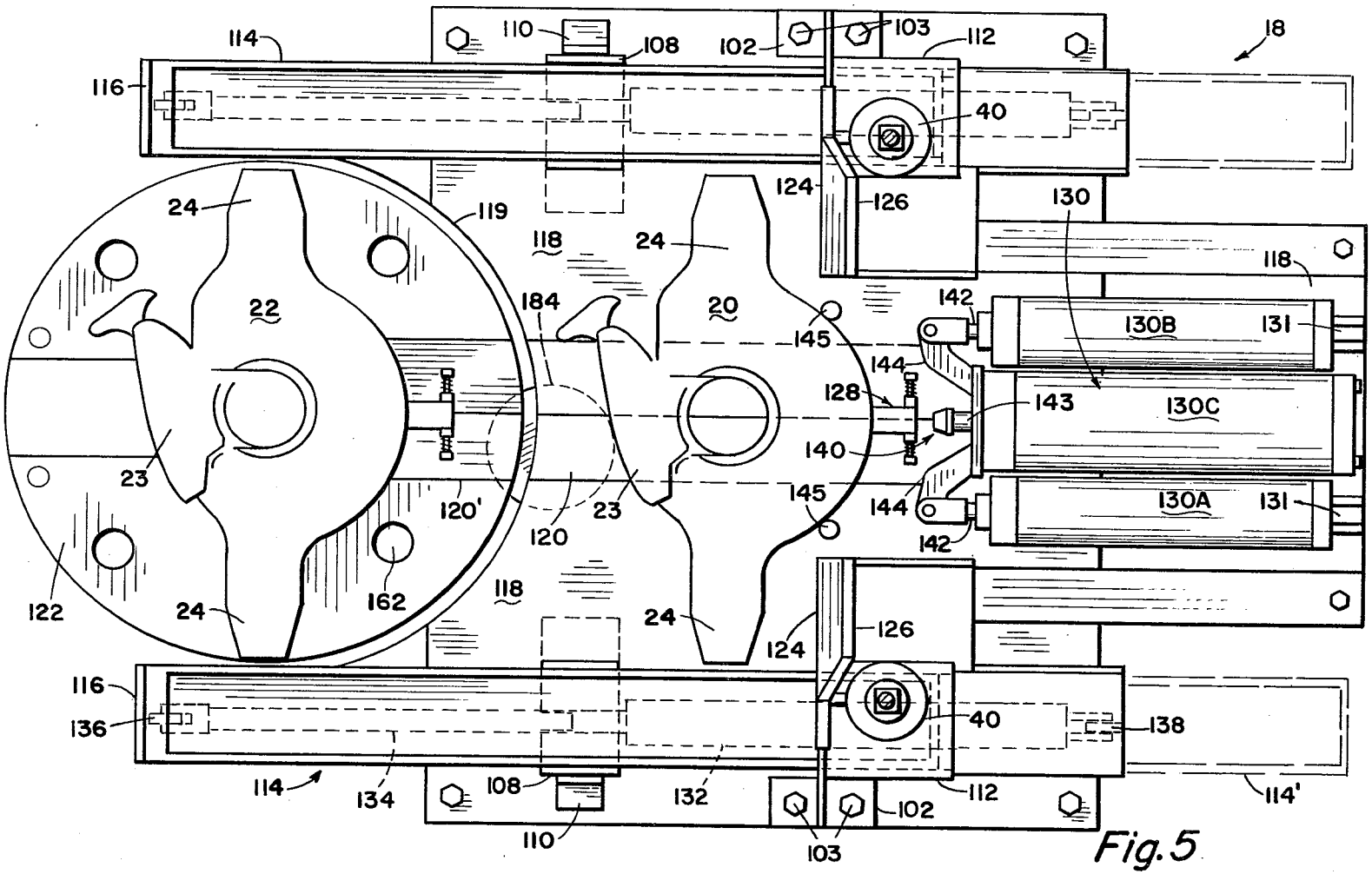

Since it would obviously be difficult to describe the complete construction and procedure for using the setback platform of this invention without some knowledge of the other portions of the system as illustrated in FIG. 1, the three FIGS. 1, 2, and 3, are included herein which are respectively FIGS. 1, 4, and 5 of co-pending application, Ser. No. 164,002. These will be described so as to provide an introduction to the setback platform.

The lifting means 12 is supported by sheaves and cables from a crown block at the top of the drilling tower (not shown) in a conventional manner. The vertical position of the lifting means is controlled by means of a cable and drum which is entirely conventional and needs no further description. In the figures it is clearly shown that there are two links 10A and 10B which have open loops at their top ends. The top ends of the links 10A and 10B are respectively hung from, and locked to, a pair of hooks 16 on the sides of the lifting means 12.

Control means are attached to the lift member which can control the verticality of the position of the links 10A and 10B. Normally while supporting the drill pipe or other heavy object the links would be perfectly vertical and parallel to the center axis of the lift member and of the borehole. However, during the transfer process in which the links are removed from a first elevator and positioned on a second elevator, the links must be spread apart and lowered, to be released from a first elevator and they must then be tilted backwardly or forwardly, so as to be attached to a second elevator which is in the setback position on the setback platform. The link control system also places the empty elevator on the setback platform or picks up the empty elevator from the setback platform.

Reference has been made to Guier U.S. Pat. No. 3,063,509 which introduced the dual elevator system to the petroleum industry. This invention is concerned with the setback platform means for handling dual elevators which provides a means for supporting the two elevators on the setback platform—one in an operating position over the borehole, and a second in a setback position back from the borehole.

In FIG. 1 two elevators are shown. One elevator 22 is supporting a drill string by the tool joint 34. The remaining part of the drill string is, of course, extending downwardly into the earth. A second elevator 20 is shown in a setback position on the surface of the setback platform.

As the lift means or hook moves vertically, it is guided by the cables 36, in combination with guides 30 and 32 which surround and are guided by two vertical cables which have a selected tension applied to them. These guide cables control the lifting means 12 so that it is at all times centered over the borehole and coaxial with the tool joint 34 shown in FIG. 1. A downwardly depending U-shaped member 48 is joined by hinge means with portions 44 and 46, one on each side, which depend from arms 26, 28 respectively. U member 48 has two arms 48A, 48B which are joined at their ends by a transverse portion 48C. There is also a U-shaped bracket 52 which is attached perpendicularly to the U-shaped member 48. A pair of hydraulic or pneumatic cylinders 56A, 56B (either type can be used as selected) serves to tilt the members 48 and 52 at the hinge points. On the transverse horizontal member 52C are brackets 70A, 70B to which is attached a second cylinder-piston 74 which operates a linkage attached to the horizontal member 48C as shown more clearly in FIGS. 2 and 3.

The link control mechanism just described is shown in FIG. 2 in a vertical position with the piston 58 of the cylinder 56 extended. When pressurized fluid is supplied to the cylinder 56, the piston is withdrawn as shown in the dashed outline 56', 58' and so on, so that the vertical portion of the U member 48 is tilted toward the left of the drawing, which is away from the axis of the borehole, towards the setback position of the second elevator 20.

The cylinder-piston 74 controls by control members 62A and 62B, which are respectively attached by means of clamps to the links 10A and 10B. Thus, when the piston 73 of the cylinder 74 is moved outwardly, the members 62 cause the links 10A and 10B to be spread apart as shown in FIG. 3.

Of course, if the drill string is being supported by the links 10A and 10B at the present moment, the force of the cylinder 74 is far from being strong enough to push those links apart. However, once the elevator 22 is lowered onto the rotary table so that the rotary table supports the elevator 22 and the drill pipe 34, then as the lifting member 12 is lowered still farther, the open loops 10B1 and 10A1 are lowered so that they can be moved laterally, to move away from the hooks 24 on the elevator. Once they have been displaced sideways or laterally by means of cylinder 74, they can then be tilted back from the borehole toward the second elevator 20 which is in a setback position on the deck of the setback platform.

The setback platform has a pair of troughs 114, which will be fully described in later drawings, which serve as guides by means of which the loops 10B1 and 10A1 can move from a forward position in relation to elevator 22 to a back position or setback position where they are in alignment with the hooks 24 of the elevator 20. The lift member 12 is then raised, the cylinder 74 draws in its piston rod, and the spreading mechanism causes the links to move inwardly to become more parallel. As the lift continues, the open loops 10B1 and 10A1 will hook under shoulders or hooks, or horns, 24 of the elevator 20. If the lifting member 12 is raised farther, the links 10A and 10B will now become fully engaged in the hooks 24 of the setback elevator, and it will be lifted upwardly from the deck or top plate of the setback platform.

FIGS. 1, 2, and 3 and the above description provide the environment in which the present invention operates. Not all of the features of FIGS. 1, 2 and 3 have been described. While they may be critical to the design of the link control mechanism, they are not critical to this present invention.

Figure 6:
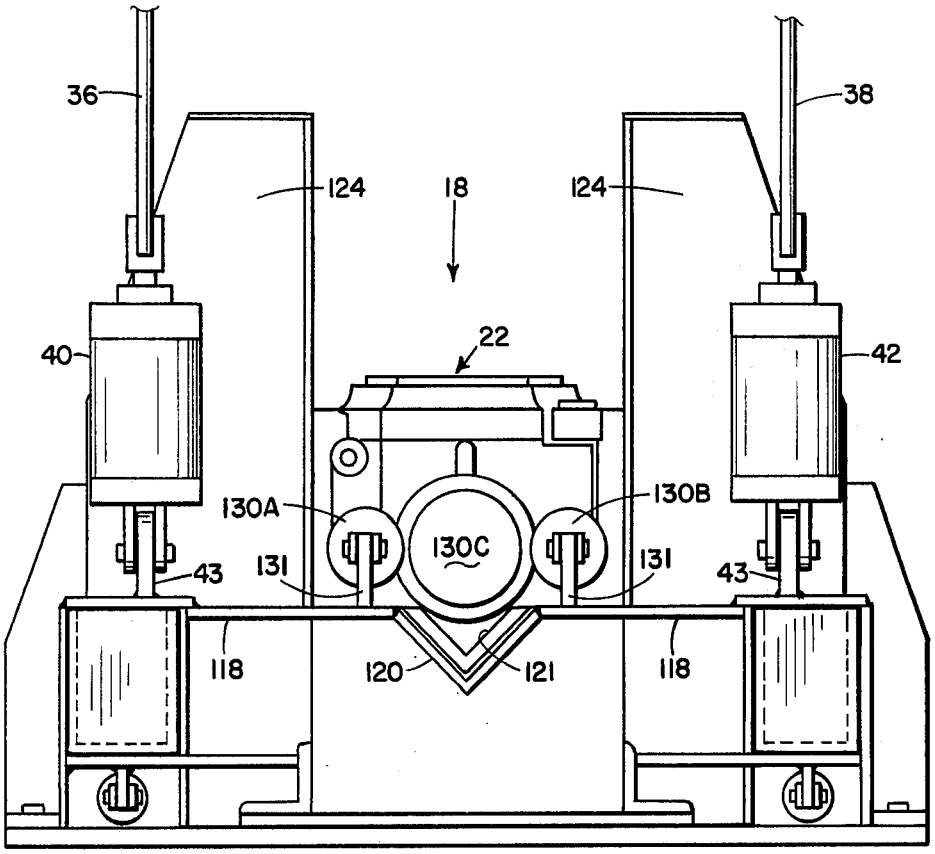
FIG. 6 is an end view of the setback platform means.

Reference is now made to FIGS. 4, 5, and 6 which represent respectively a side elevational view, a plan view, and an end view of the setback platform.

The dual elevators which have been described in conjunction with FIG. 1 form no part of this invention. They are covered in Guier U.S. Pat. No. Re 29,995 and will not be described further, other than to point out (as shown very simply in FIG. 5 in the plan view) that there is a door 23 which is hinged in the side of the elevators 22 and 20, so that with the door open, an elevator can be moved forward from the setback position to be positioned around a pipe so that when the door is closed and locked, the pipe is locked inside of the elevator and cannot be removed. Also, when it is desired to remove the elevator from a position encircling the drill pipe, the door 23 is opened and the elevator is withdrawn backwardly along the axis of the setback platform 18 and is moved from the position of elevator 22 to the position of elevator 20, and vice versa. Position 1 will be used to denote the position of elevator 22 in FIG. 5 wherein the axis of the opening in the elevator is coaxial with the pipe and the borehole. Position 2 will denote the setback position of elevator 20 (FIG. 4).

Referring now to FIGS. 4, 5, and 6, the setback platform is shown and comprises a framework which is mounted on and attached to the floor of the drill rig by means such as plates 102 and bolts 103. The frame has an upper deck or plate 118 which has a circular cutout 119 so that it can be fitted close to, but spaced from, the rotary table and a stool 122, which will described, which sits on the rotary table and which supports the elevator as shown in FIG. 4.

The top surface plate 118 is the same elevation as the top of the stool 122 and has a keyway 120 which can be of any selected cross-section, but is preferred to be an angular notch in the top surface of the setback platform. This keyway or notch is also carried 120' into the top surface of the stool 122. This notch is shown more clearly in FIG. 6. Also, there is a corresponding key 121 on the bottom of each of the elevators 22, 20 which is adapted to fit into and slide along the keyway 120 as the elevator is moved from position 1 where it is centralized over the borehole, to position 2, the setback position, and vice versa.

Pneumatic or hydraulic cylinders, indicated generally by the numeral 130, are mounted on the top platform 118 at the rear of the setback platform; and two smaller cylinders 130A and 130B are attached at their rear ends by means of brackets 131. Pistons 142 are connected to a common rigid member 144 which supports a cylinder 130C. Thus, as pressurized fluid is led into the cylinders 130A and 130B, their pistons 142 move outwardly (to the left in the drawing) and carry the bracket 144 and the cylinder 130C.

Figure 7:
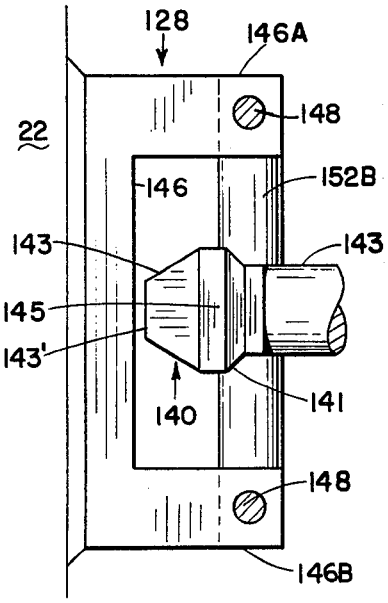
FIGS. 7 and 8 illustrate two side elevation views of the mechanism for attaching and detaching the cylinder-piston apparatus for moving an elevator from a position over the borehole to the setback position, and vice versa.
Figure 8:
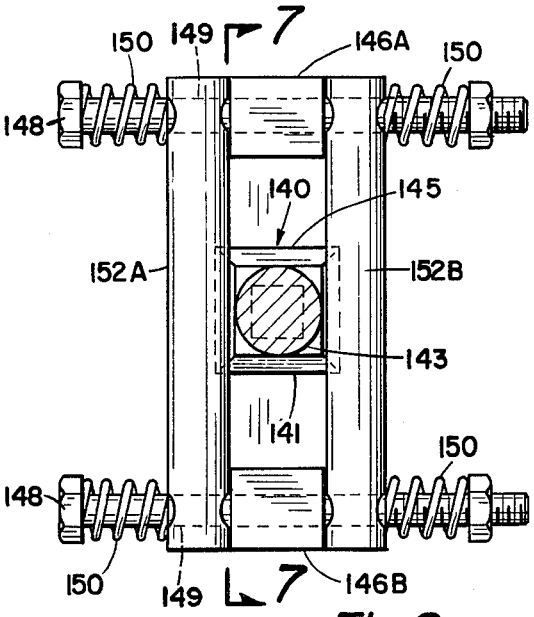

The piston 143 of the central cylinder 130C has, at its outer end, an attachment means 140 which will be described more fully in relation to FIGS. 7 and 8. The means 140 can be attached and detached by mechanism 128 to an elevator such as 20 by extending the pistons of cylinders 130 A, B, and C. The elevator 20 can be pushed forwardly from the setback position 2 along the keyways 120 and 120' to position 1, concentric with the borehole, now occupied by the elevator 22. Also, the cylinder and piston mechanism 130 can be used to withdraw an elevator from position 1, where elevator 22 is shown, back along the keyway 120' and 120 to the setback position 2, shown by elevator 20.

There are two rectangular troughs 114 which are parallel and spaced apart by a distance great enough to be positioned along the sides of, but spaced apart from, the rotating rotary table and stool 122. The troughs are closed by end plates 116 which serve as guides to cause the links as they are lowered to fit into the troughs or channels 114 and be guided backwardly along the troughs.

Shown in FIG. 4 is a situation where the pair of links 10A, 10B (only one of which, 10A, is shown) are in position to support the elevator 22 in its position over the borehole. The loops 10A1 and 10B1 (not shown) at the bottom ends of the links 10 are lowered sufficiently that they can be spread apart by the link control mechanism previously described in connection with FIGS. 1, 2, and 3. They then will be further apart than the horns or hooks 24 of the elevators, and they can then be lowered into the troughs 114.

At this time, if the link control mechanism previously described is operated to draw the links backwardly, link A will then take a position such as link 10A' where it is stopped by contact with the batter boards 124 which serve as stops. The batter boards serve to position the lower loops 10A1 and 10B1 of the links exactly opposite the hooks of the elevators (such as 20) when they are in the setback position. If the links happen to be in the retracted position and it is desired to hook them to an elevator sitting in position 1, they are moved forwardly by the link control means until they hit the end stops 116. They then are in a proper position for lifting and coming together to hook under the hooks 24 of the forward elevator 22. Elevator 22 can be lifted while supporting the drill pipe in the borehole.

On the other hand, when the elevator 20 is to be lifted, the links are moved backwardly along the trough 114 to the stops 124. They are then lifted and moved together and will automatically hook under the hooks 24' and will lift the elevator vertically from the top plate 118 of the setback platform.

After the pipe is hanging from the lifting means or hook and is being rotated in a conventional manner and drilling is progressing, the troughs 114 can be withdrawn as shown by their dashed positions in FIGS. 4 and 5. When retracted, they will be away from possible contact with the rotating mechanism. Also, they will permit other activities in the vicinity of the rotary table that may have to be taken care of.

In reviewing the operation of the setback platform as previously described, it is clear that there are several important uses for the setback platform. First and foremost, they can store and handle one or the other, or both, of the elevators which can be stored—one on the rotary table and stocl, and the other on the setback platform. It serves also to move an elevator from position 2 to position 1, and vice versa. It also provides guides to which the bottom end of the links can be lowered so that they can be positioned precisely in a direction along the axis of the setback platform.

Shown in FIGS. 4 and 5 are the piston-cylinder operators 130 that are used to move the elevators from one position to the other. This is accomplished in connection with a fitting or head 140 on the end of the piston 143 of the central cylinder 130C. This is designed to cooperate with a mechanism 128 shown in FIGS. 7 and 8, which is attached to the back surface of each of the elevators. As shown in FIG. 7, this mechanism is generally indicated by the numeral 128 and comprises a U-shaped bracket having two arms 146A and 146B which have holes bored horizontally through the ends of the arms. There are two cylindrical bars 152A and 152B, also with holes 149 drilled near their ends. They are mounted by means of long bolts 148 and springs 150 and corresponding nuts, so that the springs provide a selected force to hold them in contact with the arms 146A and 146B.

Bars 152A, 152B are shaped to receive the head 140 that is a part of the piston rod 143. The shape of the head 140 comprises a four-sided pyramid 143 having a selected slope to the four surfaces, and a similar but shorter four-sided pyramid 141, truncated like the first one, on the back side of the head 140.

Consider that the piston rod 143 is disconnected and is off to the right, as shown in FIG. 5, and moves forward into contact with the bars 152A and 152B. The prismatic portion 143 slides between the two bars and spreads them apart and moves forwardly until its end 143' presses against the U member 128. Now the piston and cylinder arrangement 130 can be extended, thus pushing the elevator 20 along the keyway 120, 120' to the front position.

If the door 24 of the elevator 20 is open, then as this elevator is moved forwardly it will slide around a pipe which may be suspended in the stool and rotary table; and by closing the door and locking it, the pipe is now locked inside of the elevator in the first position. With the elevator locked around the pipe, the piston rod 143 can be withdrawn. Since the elevator is now locked in its position, and even though the slope of the prism 141 is flatter than the portion 143, retraction of piston rod 143 will force the two bars 152A and 152B to be spread apart against the force of the springs 150, and the piston rod head 140 can be withdrawn and the piston cylinders 130 moved back into the nonextended position shown in FIGS. 4 and 5.

When the elevator 22 in position 1 is not locked to the pipe and the piston rod 143 and head 140 are engaged in the fixture 128, the elevator can be pulled back along the keyway to its setback position 2, where it presses against a pair of stops 145 attached to plate 118. Further pulling of the piston rod 143 serves to spread the bars 152 and permit the piston rod head to be withdrawn.

Figure 9:
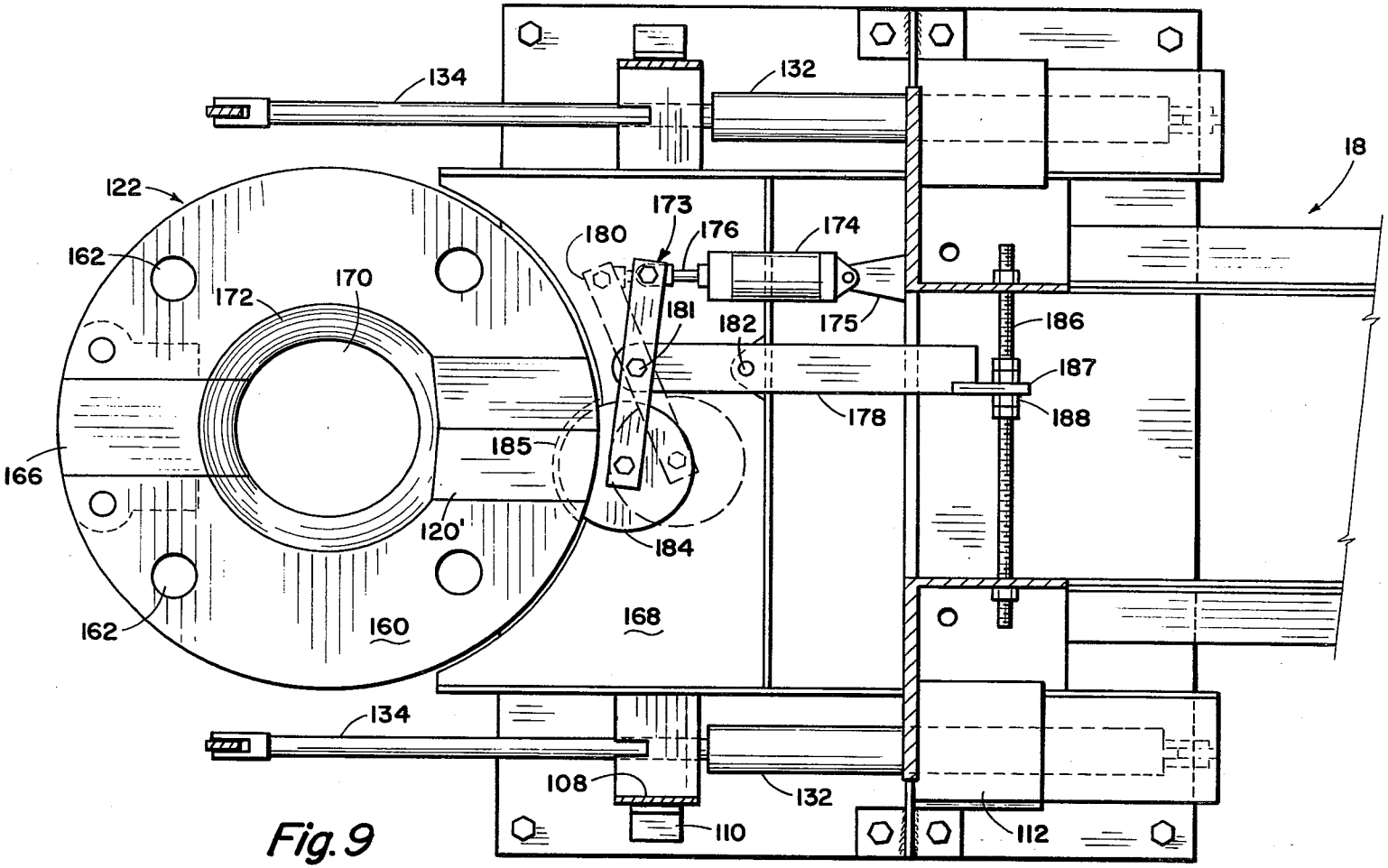
FIG. 9 is a horizontal section through the setback platform which shows the indexing means by which the azimuth of the rotary table is fixed with respect to the axis of the setback platform.

Referring now to FIG. 9, there is shown a plan view taken across the plane 9—9 of FIG. 4. This shows clearly the mechanism 173 for indexing the rotary table position to the position of the setback platform 18. There is shown a circular notch 185 in the side of the stool 122. A wheel 184 of substantially the same radius as the notch 185 is mounted on a pin, on arm 180. Arm 180 is pivoted at 181 on a second arm 178 which is pivoted at a fixed point 182. A cylinder 174 is anchored to the frame by bracket 175, and its piston 176 is attached to the end of the arm 180 opposite to that to which the wheel 184 is journalled. When the piston rod 176 is extended, the wheel 184 moves away from the rotary table, permitting the rotary table to rotate freely.

However, if there is to be a change in pipe or for any other reason the string has to be broken, it is important that the rotary table is turned to a specific azimuth, such that the opening 185 will accept the wheel 184. This ensures that the keyway shown as 120' in the stool, will line up with the keyway 120 shown in FIG. 5 in the top plate of the setback platform. In other words, before the elevators can be moved to or from the stool to the setback position, the rotary table must always be indexed as shown in FIG. 9 and locked in that position until it is decided to rotate the rotary table. In this case the cylinder 174 is extended and the wheel 184 is withdrawn from and is free of the rotary table.

The arm 178 has an adjustment, as shown by the screw 186 attached to the frame of the setback platform. Thus, by moving the nuts 188 along the screw, the arm 178 can be rotated, which displaces the wheel laterally with respect to the axis of the setback platform so that the indexing hole 185 can be thereafter positioned properly with respect to the two portions of the keyway 120 and 120'.

Shown in FIGS. 4 and 9 are a pair of cylinders 132 and pistons 134, one under each of the troughs 114, by means of which the troughs can be retracted or extended as has previously been discussed, guided by 108 and 112.

Figure 10:
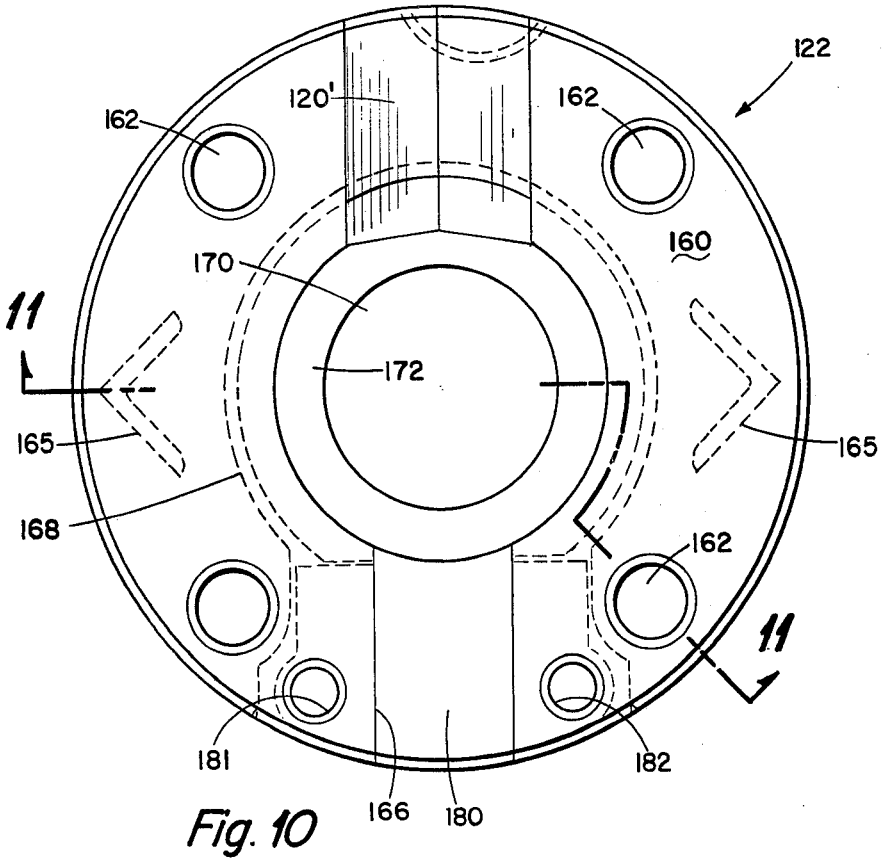
FIGS. 10 and 11 illustrate respectively a plan and vertical section of a typical stool which is used in conjunction with the setback platform to complete the elevator support and transfer system.
Figure 11:
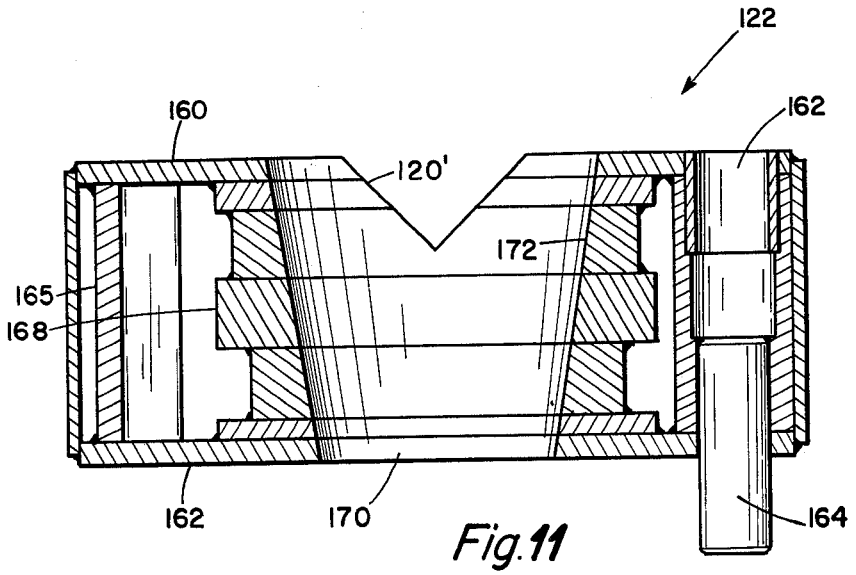

Referring now to FIGS. 10 and 11, there are shown respectively a plan view and a vertical section taken across the plane 11—11 of FIG. 10. This is a stool 122 which sets on top of the rotary table and is pinned to it by means of four pins 164, which are received in four bored openings 162. The kelly bushing (not shown but well known) which rotates the kelly, sits on top of the stool and is pinned to the stool by four pins similar to 164 that fit into the openings 162. The pins 164 of the stool fit into four openings like 162 in the top of the rotary table. The pins of the kelly bushing fit into the openings 162 of the stool, and the pins 164 of the stool fit into the rotary table. It is through these means that the rotary table can drive the kelly and the pipe.

As shown in FIGS. 10 and 11, the stool 122 is formed by a top plate 160 and a paralleled bottom plate 162. Intermediate the top and bottom plate are structural portions 168 which provide an opening 170 through the stool with a tapered sidewall 172. Cylindrical structural members are used to provide the openings 162 and reinforcing angular structure members 165 are employed to reinforce the top and bottom plates 160, 162. To provide means wherein the stool 122 may be removed from or inserted about a piper, a side opening 166 is formed in the top and bottom plates. This opening is closed by a removable door 180. Door 180 and top and bottom plates 160, 162 have aligned openings 181 and 182 therein which receive a bolt or pin (not shown) to hold the door in place. To position the stool about a pipe, the door is removed, and when it is placed about the pipe on the rotary table, the door is replaced and bolts or pins placed in openings 181 and 182.

The opening 170 through the stool receives the drill pipe and kelly during drilling operations. By the use of dual elevators as described herein, it is not necessary to use slips which are commonly employed in other drilling systems. However, if standard drilling slips are required for any purpose, they may be positioned in the tapered opening 170 in the stool.

What has been described is an apparatus for assisting and serving as part of the improved drilling system. The purpose of this feature is to provide a framework which can be attached to the drilling floor in selected proximity to the rotary table. It is locked to the drill floor and has cylinders such as 40 and pistons 37 which can be attached to and provide adjustable tension in cables 36 which guide the lifting means to move vertically about the borehole. Further, it provides two retractable troughs which serve as guides and stops for the backward and forward movement of the bottom ends of the lifting links to position, or to pick up, an elevator as needed from the setback platform. The elevator may be in the first position over the borehole or the setback position back from the borehole. Hydraulic or pneumatic means is provided for moving an elevator to or from the setback position, from or to the position concentric with the borehole.

While the rotary table is not clearly shown, its position is well known in the art and need not be described further. Also, its position can be inferred from the fact that the stool 122 is mounted coaxially on top of the rotary table.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. In a rotary drilling apparatus having a rotary table, a link control means attached to the links of a lifting means such as a travelling block, the travelling block being supported from a crown block in the tower of the drilling apparatus, the link control means serving to control the lateral position of two bales or links hanging from the travelling block, and two substantially identical elevators, each adapted to be carried separately by said bales, the improvement providing setback platform means to support the two elevators in two working positions, and to facilitate the engagement or disengagement of said links to or from each of the elevators comprising:

a cylindrical stool having a sidewall and having a vertical, axial opening therethrough for receiving drill pipe, the stool being supported on and rotatably attached to the rotary table;

a frame means adapted to be supported in a selected position in close proximity to the rotary table of the drilling apparatus;

a pair of parallel troughs supported from said setback platform means and spaced apart so as to straddle and extend along the opposite sides of said rotary table, said troughs being dimensioned to receive the bottom ends of said two links therein when said links are spread apart and are lowered, the troughs providing guiding force both inwardly and outwardly with respect to said stool to properly position said links to engage said elevators;

said setback platform means having a horizontal deck at the same height as the top of said stool, when positioned on top of said rotary table, said deck and said stool having a colinear longitudinal groove or keyway cut into said deck and the top of said stool, adapted to receive a corresponding key on the bottom of each of said elevators;

means attached to said setback platform means to move an elevator from a first position over said stool; to a setback second position on said deck, and vice versa; and, including means to traverse said troughs longitudinally along said frame.

2. The setback platform means as in claim 1 and two parallel vertical cable means supported in the tower at their top ends and attached to said platform means at their bottom ends, said cables adapted to be used as guides for said lift means.

3. The setback platform means as in claim 1 including means on said frame to index the position of said rotary table with respect to said platform means.

4. The setback platform means as in claim 1 in which said means to traverse said troughs comprise piston and cylinder means.

5. The setback platform means as in claim 1 in which said keyway comprises a V notch.

6. The setback platform means as in claim 1 in which said means to move said elevators along said keyway comprise cylinder and piston means.

7. The setback platform means as in claim 6 including push/pull coupling means between said hydraulic cylinder and piston means and said elevator means.

8. The setback platform means as in claim 7 in which said coupling means comprise a longitudinal rod having a head, attached to said piston means, and a frame having two spaced parallel rods supported in a frame, and adapted to be pressed toward each other by spring means.

9. The setback platform means as in claim 8 in which means to move comprises two parallel spaced cylinders anchored to a transverse bar, the two pistons in said two cylinders attached to a transverse bar, which carries a third hydraulic cylinder inbetween said two spaced cylinders, said coupling means attached to the piston rod of said third cylinder.

10. The setback platform means as in claim 1 including:

indexing means cntrollable to index the azimuth of the rotary table with respect to the axis of the setback platform.

11. The setback platform means according to claim 10 wherein said indexing means includes a notch formed in the sidewall of said stool; and an indexing member for resiliently engaging the stool sidewall and for entering into said notch in said stool to cause the rotation of said stool, and thereby the rotary table into position, at a selected azimuth.

12. The setback platform and stool according to claim 1 in which said stool has a side opening in the sidewall thereof so that the stool may be positioned around or removed from a drill pipe, and including:

a removable door closing said side opening.

13. The setback platform and stool according to claim 1 wherein said stool includes means of non-rotatably receiving a kelly drive thereon.

14. The setback platform and stool according to claim 1 wherein said vertical exit opening through said stool is tapered and is adaptable to receive slips therein.

* * * * *